US005587730A

United States Patent [19]

Karz

[11] Patent Number: 5,587,730

[45] Date of Patent: Dec. 24, 1996

[54] REDUNDANT FULL WIDTH ARRAY THERMAL INK JET PRINTING FOR IMPROVED RELIABILITY

[75] Inventor: Robert S. Karz, Webster, N.Y.

[73] Assignee: Xerox Corporation, Stamford, Conn.

[21] Appl. No.: 316,142

[22] Filed: Sep. 30, 1994

[51] Int. Cl.[6] ..... B41J 2/21; B41J 29/38

[52] U.S. Cl. ..... 347/43; 347/13

[58] Field of Search ..... 347/43, 35, 85, 347/13, 171

[56] References Cited

U.S. PATENT DOCUMENTS

| | | | |
|---|---|---|---|
| 4,833,491 | 5/1989 | Rezanka . | |
| 5,057,854 | 10/1991 | Pond et al. . | |
| 5,179,418 | 1/1993 | Takamiya et al. . | |
| 5,398,053 | 3/1995 | Hirosawa et al. | 347/13 |

FOREIGN PATENT DOCUMENTS

| | | |
|---|---|---|
| 4-276446 | 3/1991 | Japan . |
| 4-315916 | 11/1992 | Japan . |

*Primary Examiner*—Benjamin R. Fuller
*Assistant Examiner*—Thinh Nguyen
*Attorney, Agent, or Firm*—Oliff & Berridge

[57] ABSTRACT

A thermal ink jet printer having redundant printing capability includes a primary printhead for printing ink drops of a first color and a secondary printhead for printing ink drops of the first color and/or other colors. The secondary printhead selectively prints according to either a first mode or a second mode. In the first mode, the secondary printhead supplements the primary printhead such that both printheads print ink drops of the first color. In the second mode, if the primary printhead fails, the secondary printhead prints ink drops of the first color in place of the primary printhead.

18 Claims, 4 Drawing Sheets

REDUNDANT FULL WIDTH ARRAY THERMAL INK JET PRINTING FOR IMPROVED RELIABILITY

BACKGROUND OF THE INVENTION

This invention relates to thermal ink jet printing and, in particular, to providing redundant printing capability for improving the reliability of a printer.

Printers using full width printheads (i.e., printbars) are known to offer several advantages over conventional printers in which a single printhead travels back and forth across the printing medium. The advantages of full width (or page width) printheads include faster printing speed, improved reliability, and quieter operation.

Nevertheless, full width printheads using thermal ink jet technology suffer from a drawback. A full width printhead may include 7200 or more discrete marking elements (i.e., ink jets), each of which must function properly to ensure that a high quality image is produced. Having such a great number of discrete ink jets increases the probability that any single ink jet will fail. Since no practicable method exists for repairing ink jets, the failure of a single ink jet requires the replacement of the entire full width printhead. In addition to imposing an undesirable expense, a nonfunctioning full width printhead results in a considerable loss of printing time and inconvenience while a new full printhead is obtained and installed.

As known in the prior art, failed ink jets can be detected through the use of a drop sensor that recognizes missing or misdirected drops. Several drop sensing devices use a light beam that projects across the width of the printing medium and between the printhead and the printing medium to a detector. Based upon the timing and degree of oclusion caused by an ink droplet passing through the light beam, the devices can sense the size and directional accuracy of the ink droplets. A laser may also be used to generate the light beam. For example, Japanese Laid-Open Patent Application No. 4-315914, assigned to Fujitsu Ltd., discloses a method of detecting failed ink jets by comparing variations in the flight angle and flight time of each ink droplet to known values. Other examples of drop detecting devices and methods are disclosed in U.S. Pat. No. 5,179,418 and Japanese Patent Application No. 4-276446.

Conventionally, a full width thermal ink jet printhead usually comprises a number of individual ink jet print dies attached to a substrate that serves as a heat sink. The individual print dies, which each contain up to several hundred individual ink jets, can be attached to the substrate according to a number of different configurations. The individual printheads can be disposed in a linear array such that each printhead is in contact with each adjacent printhead. Alternatively, the individual printheads can be spaced apart along both sides of the substrate in a staggered pattern such that each printhead is attached to one side of the substrate and disposed opposite a space on the other side of the substrate. Accordingly, the printheads on either side of the substrate cannot print a continuous line of text, but all of the printheads on both sides of the substrate, taken together, produce a continuous line of text across the width of a recording medium. For other variations of full width printhead configurations, see, e.g., U.S. Pat. No. 5,057,854, issued to Pond et al., the disclosure of which is hereby incorporated by reference.

For color printing applications, several full width printheads are often used in conjunction with one another. Each full width printhead is separately supplied with ink of a different color. In the most common configuration, four full width printheads are used to print the primary colors of black, cyan, magenta, and yellow inks. Each of the four full width printheads is disposed above the surface of the recording medium, perpendicular to its direction of travel and parallel to the other full width printheads.

Even in color printers, however, most printing requires the use of black ink. As a result, a full width printhead for printing black ink is more likely to fail than the other full width printheads. Considering the impracticability of repairing a full width printhead and the importance of ensuring high reliability, providing a redundant configuration in the case of a failed full width printhead would be advantageous.

From a theoretical perspective, the increased reliability of a printer having a redundant configuration can be expressed according to known mathematical relationships. Assuming the phenomenon of ink jet failure to be random, F represents the failure rate for an individual jet. Accordingly, for N printheads, the probability that a particular location on the printhead will have at least one operating jet is:

$$(1-F^N)$$

If there are n jets on a printhead, the probability P that the ink jets at all locations are functional is:

$$P=\{(1-F^N)\}^n$$

Assuming that N is 7200 (i.e., that there are 7200 ink jets on the printhead) and P is 0.95 (i.e., only one printhead out of 20 fails), the individual ink jet failure rate F can be expressed as a function of the number of full width printheads:

| Number of Print Bars, N | Individual Failure Rate, F Over Printhead Life |
|---|---|
| 1 | 0.0000071 |
| 2 | 0.00267 |
| 3 | 0.0192 |
| 4 | 0.0517 |

As shown above, if four full width printheads are used, more than 5% of the individual jets can fail before the printing reliability in a monochrome mode drops below 95%.

SUMMARY OF THE INVENTION

It is therefore an object of the invention to provide a printer having improved reliability.

It is therefore another object to provide a printer having redundant printing capability.

It is therefore a further object to provide a printer that can be automatically or manually reconfigured after a printhead failure occurs.

It is therefore a still further object to provide a printer in which one of the functioning full width printheads can be reconfigured to serve in place of a failed full width printhead.

According to a first embodiment, one of the full width printheads in a thermal ink jet printer can be automatically or manually reconfigured to print ink of the color that was previously printed by the failed full width printhead. In other words, if the full width printhead connected to the black ink supply fails, the structure of the invention enables the cyan, magenta or yellow full width printhead can be automatically or manually connected to the black ink supply. Although this embodiment virtually ensures that the printer can always print any single desired color of ink, the full color capability of the printer will be lost.

According to another embodiment, at least one additional full width printhead is provided. In the case of the color printer described above, the additional or secondary full width printhead could be configured to operate in two modes. In a first mode, the secondary full width printhead would be devoted to printing solely, e.g., black ink. Under normal operating conditions, this secondary printhead would, through its use in printing alternate rows of drops, permit monochrome printing at up to double the normal speed. In a second mode, the secondary printhead could be reconfigured from printing black ink to printing ink of the color of the failed full width printhead. Although the monochrome printing speed with the secondary full width printhead reconfigured in the second mode would decrease, the printer would still have full color printing capability.

BRIEF DESCRIPTION OF THE DRAWINGS

A complete understanding of the present invention may be obtained by reference to the accompanying drawings, when considered in conjunction with the subsequent detailed description thereof, in which.

DETAILED DESCRIPTION OF PREFERRED EMBODIMENTS

Figure 1:
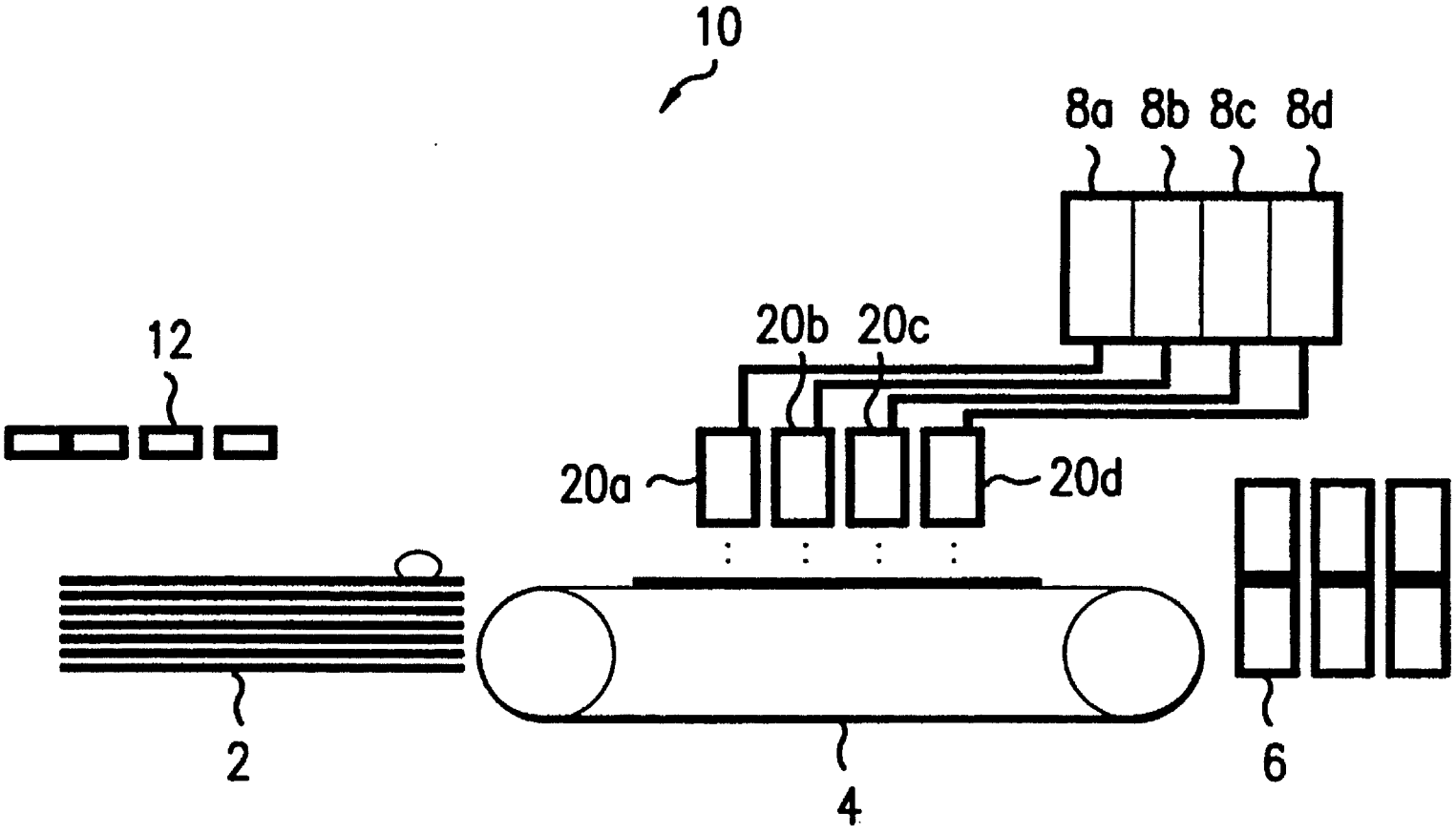
FIG. 1 is a schematic side view of a thermal ink jet having multiple full width printheads.

Referring to the drawings, in particular FIG. 1, reference numeral 10 depicts a thermal ink jet printer having multiple full width printheads 20*a*, 20*b*, 20*c*, 20*d*. Each full width printhead 20*a*, 20*b*, 20*c*, 20*d* is connected to an independent ink supply 8*a*, 8*b*, 8*c*, 8*d*, respectively. The recording medium, e.g., paper or film, is drawn from a paper feeder 2 onto a paper transport 4 and under the full width printheads 20*a*, 20*b*, 20*c*, 20*d*. The full width printheads 20*a*, 20*b*, 20*c*, 20*d* expel black, cyan, magenta, and yellow inks, respectively, onto the recording medium according to commands sent from a remote computer (not shown) or the thermal ink jet printer 10. A dryer 6 is disposed near the exit side of the paper transport 4 to assist drying of the printed recording medium. A maintenance station 12 also interacts with the thermal ink jet printer 10. The maintenance station may contain a known drop sensor (not shown) for detecting missing or misdirected drops that are characteristic of a nonfunctional ink jet. Alternatively, the drop sensor may be positioned between the printing medium and the printhead to detect faulty jets during the printing operation.

Figure 2:
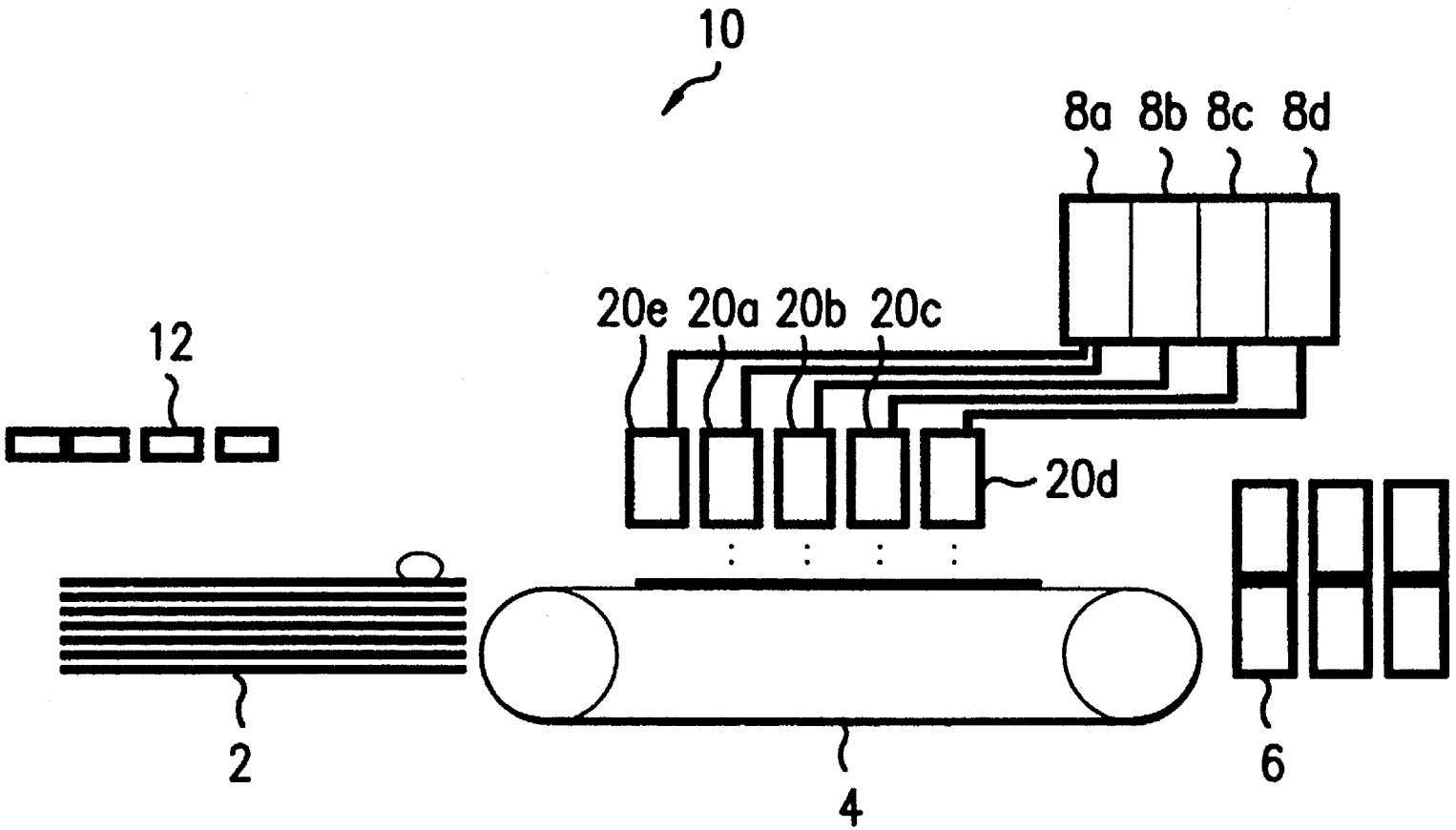
FIG. 2 is a schematic side view of a thermal ink jet having multiple full width printheads and an additional secondary full width printhead.

FIG. 2 depicts a schematic side view of the thermal ink jet printer 10 having a secondary full width printhead 20*e*. As shown, both the secondary full width printhead 20*e* and the black ink full width printhead 20*a* are connected to the black ink supply 8*a*. Alternatively, the secondary full width printhead 20*e* can be connected to any of the other ink supplies 8*b*, 8*c*, 8*d*.

Figure 3:
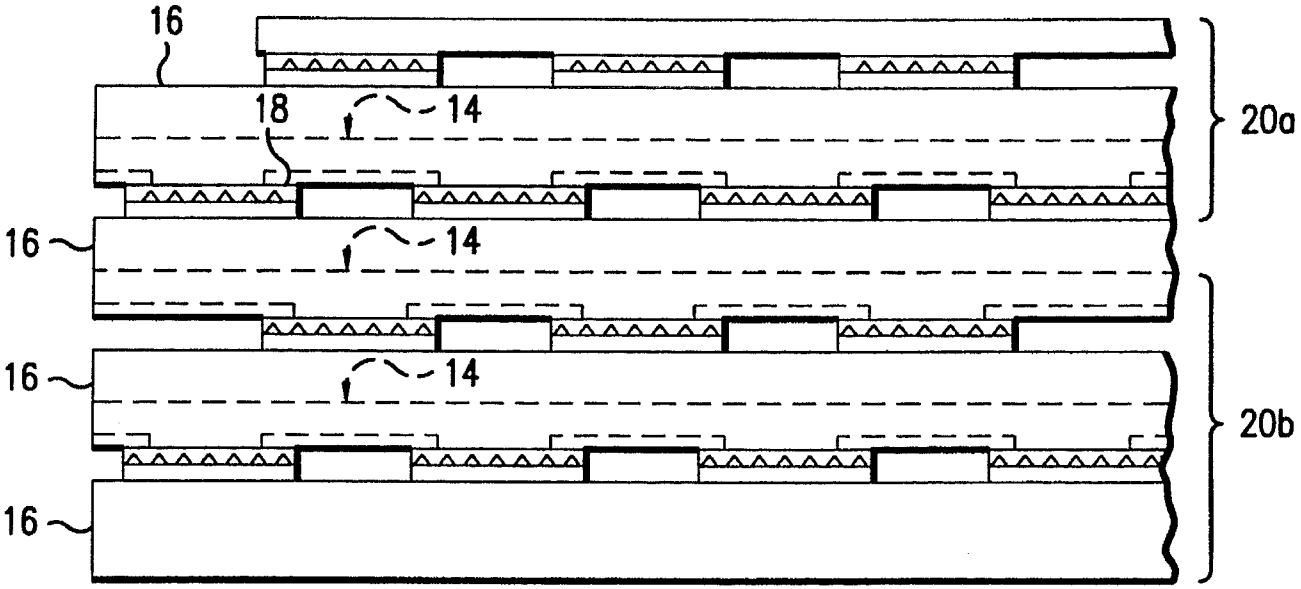
FIG. 3 is a detailed partial view of two full width thermal ink jet printheads in a staggered configuration.
Figure 3A:
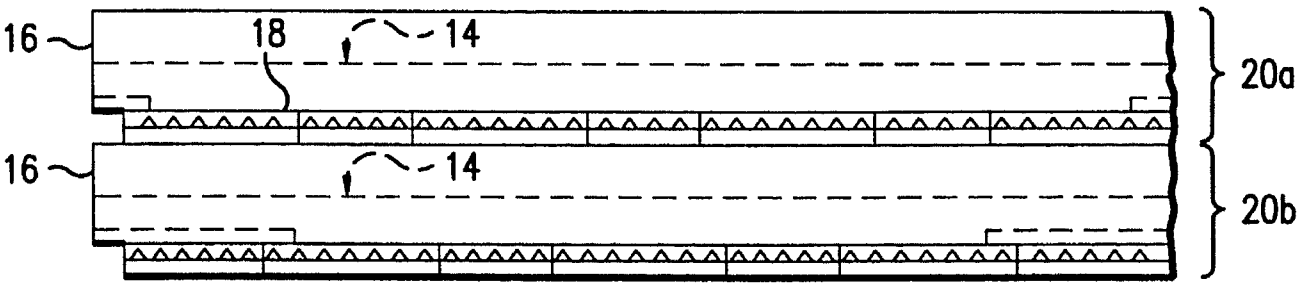
FIG. 3A is a detailed partial view of two full width thermal ink jet printheads in a parallel configuration.

FIG. 3 depicts a representative configuration of the multiple full width printheads 20*a*, 20*b*, 20*c*, 20*d*, 20*e* in detail. In FIG. 3, the two full width printheads 20*a*, 20*b* are shown in a staggered array as viewed from the side under which the recording medium passes. In FIG. 3A, the two full width printheads 20*a*, 20*b* are shown in a parallel array as viewed from the side under which the recording medium passes. As shown in FIGS. 3 and 3A, individual printheads 18 are attached to substrates 16 through which ink flows within channels 14.

During operation according to a first embodiment, one of the multiple full width printheads 20*a*, 20*b*, 20*c*, 20*d*, e.g., the cyan full width printhead 20*b*, is connected to the black ink supply 8*a* after the failure of the black full width printhead 20*a* is detected. The cyan full width printhead 20*b* may be reconfigured as a black full width printhead automatically or manually.

Figure 4:
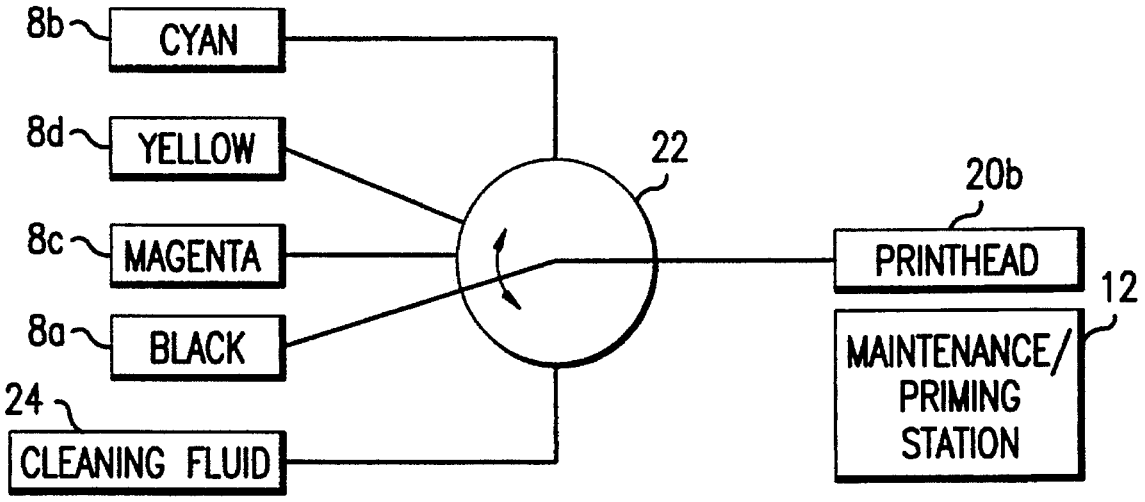
FIG. 4 is a schematic view of a valve and the connections between the valve, the various ink supplies, and one of the full width printheads.

Under an automatic reconfiguration scheme, each of the full width printheads 20*a*, 20*b*, 20*c*, 20*d* is provided with a secondary connection to at least one other full width printhead. As shown in FIG. 4, a valve 22 disposed at the junction of the primary and the secondary connections is switched to allow ink to flow from the ink supply 8*a* through the secondary connection to the reconfigured full width printhead 20*b*. Additional interconnections between the full width printheads 20*a*, 20*b*, 20*c*, 20*d* can also be provided (not shown). A cleaning fluid reservoir 24 can also be connected by the valve 22 to the cyan full width printhead 22*b*. U.S. Pat. No. 4,833,491 to Rezanka, the disclosure of which is hereby incorporated by reference, discloses a system whereby any one of a number of printheads, each being configured to print a different color and connected to its own ink supply, can be selectively purged and automatically connected to another ink supply.

Under a manual reconfiguration scheme, the user would be required to switch the valve 22 described or, in the case where no secondary connection is provided, physically disconnect the primary connection between the cyan full width printhead 20*b* and the cyan ink supply 8*b* and reconnect it to the black ink supply 8*a*. After reconfiguration, printing can resume.

According to a second embodiment, a secondary full width printhead 20*e* is provided. In operation, the secondary full width printhead 20*e* is connected to at least one ink supply, e.g., the black ink supply 8*a*. In a first mode, the secondary full width printhead 20*e* supplements the black full width printhead in printing black ink, i.e., both the black full width printhead 20*a* and the secondary full width printhead 20*e* print black ink at the same time. As a result, the monochrome printing speed of the thermal ink jet printer is increased. After the drop sensor detects a failure of one of the full width printheads, e.g., the black full width printhead 20*a*, the secondary full width printhead continues to print black ink, but monochrome printing speed decreases. If, on the other hand, the cyan, magenta, or yellow full width printhead 20*b*, 20*c*, 20*d* fails, the secondary full width printhead is automatically or manually reconfigured (as described above) to be connected to the appropriate ink supply 8*b*, 8*c*, 8*d* to ensure full color printing capability.

Although the term "secondary" has been used to denote the full width printhead that is reconfigured in the event of a failure of one of the other printheads, any of the five printheads described above can serve in either a primary or a secondary capacity.

Figure 5:
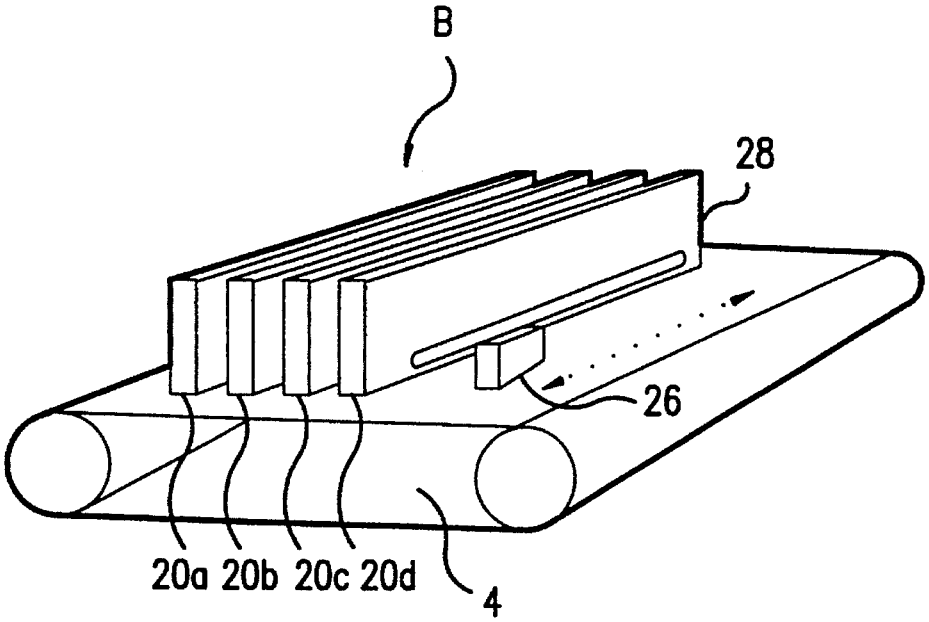
FIG. 5 is a schematic pictorial view showing a movable stand-by printhead according to an alternate embodiment.

Alternatively, FIG. 5 shows a movable stand-by printhead 26 that can be positioned in alignment with a failed jet on any of the full width printheads 20*a*, 20*b*, 20*c*, 20*d*. The stand-by printhead 26, which includes fewer ink jets than a full width printhead, can be slid along a track 28 that is disposed parallel to the full width printheads 20*a*, 20*b*, 20*c*, 20*d*. If, as indicated by the arrow B, one of the ink jets on the magenta full width printhead 20*c* fails, the stand-by printhead 26 can be positioned as shown and manually or automatically reconfigured as described above to expel magenta ink in substitution for the failed magenta ink jet.

Since other modifications and changes varied to fit particular operating requirements will be apparent to those skilled in the art, the invention is not considered to be limited to the examples chosen for the purpose of disclosure, and thus, the invention covers all changes and modifications that do not constitute a departure from its true spirit and scope.

What is claimed is:

1. A thermal ink jet printer operates in a first mode or a second mode comprising:

primary printing means for printing ink drops of a first color; and secondary printing means for printing ink drops of at least said first color, said secondary printing means selectively printing according to said first mode or said second mode, wherein said secondary printing means in said first mode operates simultaneously with said primary printing means to supplement said primary printing means, and wherein if said primary printing means fails, said secondary printing means in said second mode prints ink drops of said first color in place of said primary printing means.

2. The thermal ink jet printer according to claim 1, wherein said primary printing means and said secondary printing means comprise full width printheads.

3. The thermal ink jet printer according to claim 1, wherein said primary printing means comprises at least two full width printheads, each of said at least two full width printheads being separately connected to a distinct ink supply.

4. The thermal ink jet printer according to claim 1, further comprising a valve means for switching said secondary printing means between said first mode and said second mode, said valve means being disposed along a connection between at least one ink supply and said secondary printing means.

5. The thermal ink jet printer according to claim 1, wherein said primary printing means comprises four full width printheads, each of said four full width printheads being separately connected to an ink supply of a different color.

6. The thermal ink jet printer according to claim 5, wherein said secondary printing means comprises one of said four full width printheads, said one of said four full width printheads adapted to be reconfigured to print ink of a color corresponding to a failed printhead.

7. The thermal ink jet printer according to claim 6, wherein said one of said four full width printheads is automatically reconfigured.

8. The thermal ink jet printer according to claim 5, wherein said secondary printing means comprises a fifth full width printhead, said fifth full width printhead being disposed adjacent said four full width printheads.

9. The thermal ink jet printer according to claim 5, wherein said secondary printing means comprises a movable partial page width printhead adjacent said four full width printheads that can be aligned with a nonfunctioning ink jet of one of said four full width printheads.

10. The thermal ink jet printer according to claim 9, further comprising a track disposed parallel to said four full width printheads, said partial pagewidth printhead being movably disposed with said track.

11. The thermal ink jet printer according to claim 8, wherein said fifth full width printhead and one of said four full width printheads are connected to an ink supply of a first color, whereby said secondary printhead prints ink of said first color in said first mode.

12. The thermal ink jet printer of claim 11, wherein ink of said first color is black ink.

13. A thermal ink jet printer comprising:

a plurality of primary full width printheads, each of said primary full width printheads being separately connected to an ink supply of a different color;

a secondary full width printhead positioned adjacent said primary full width printhead that prints in a first mode or a second mode, wherein said secondary full width printhead in said first mode operates simultaneously with said primary full width printheads to supplement printing of said primary full width printheads; and means for detecting printhead failure of one of said primary full width printheads, wherein if said means for detecting printhead failure senses a failed primary full width printhead, said secondary full width printhead operates in said second mode by printing in place of said failed primary full width printhead.

14. The thermal ink jet printer of claim 13, wherein said secondary full width printhead in said second mode is connected to said ink supply of said failed primary full width printhead.

15. The method according to claim 14, wherein said primary printing means and said secondary printing means comprise full width printheads.

16. The method according to claim 15, wherein said step of connecting and said step of disconnecting said secondary printing means comprises the step of switching a valve.

17. A method of operating a thermal ink jet printer having a primary printing means for printing a first color and a secondary printing means for selectively printing according to one of a first mode or a second mode, the method comprising the steps of:

printing according to the first mode in which said secondary printing means operates simultaneously with said primary printing means to supplement said primary printing means; and printing according to the second mode with said secondary printing means if said primary printing means fails, wherein said secondary printing means in the second mode prints in said first color.

18. The method according to claim 17, further comprising detecting a failure of said primary printing means, and wherein said printing in the second mode includes connecting said secondary printing means to an ink supply of said first color.

* * * * *